US005632393A

United States Patent [19]

Houser

[11] Patent Number: 5,632,393

[45] Date of Patent: May 27, 1997

[54] TAMPER RESISTANT COVER FOR AEROSOL CAN

[75] Inventor: Kent A. Houser, Akron, Ohio

[73] Assignee: Cobra Plastics Inc., Twinsburg, Ohio

[21] Appl. No.: 539,011

[22] Filed: Oct. 3, 1995

[51] Int. Cl.[6] ..... B65D 17/42; B67D 5/06

[52] U.S. Cl. ..... 220/277; 220/284; 220/724; 220/915; 222/182

[58] Field of Search ..... 220/915, 277, 220/284, 724; 222/182, 541.6; 215/386

[56] References Cited

U.S. PATENT DOCUMENTS

| | | | |
|---|---|---|---|
| 3,544,023 | 12/1970 | Hendrickson | 222/182 X |
| 3,724,724 | 4/1973 | Gach | 222/182 X |
| 3,754,689 | 8/1973 | Blank | 222/402.11 |
| 3,804,286 | 4/1974 | Watson et al. | 220/284 |
| 3,804,302 | 4/1974 | Yamada et al. | 222/182 |
| 4,105,133 | 8/1978 | La Barge et al. | 215/253 X |
| 4,186,853 | 2/1980 | White | 222/182 |
| 4,303,175 | 12/1981 | Lux | 220/915 X |
| 5,497,906 | 3/1996 | Dubach | 215/253 X |

*Primary Examiner*—Allan N. Shoap
*Assistant Examiner*—Robin A. Hylton
*Attorney, Agent, or Firm*—John F. McDevitt

[57] ABSTRACT

A tamper resistant and tamper evident detachable cover is provided for a dispensing container so that any premature removal of the cover before customer purchase can be visually detected. The cover employs a closed opening in the top surface for subsequent perforation by the customer after purchase in order to release the cover.

1 Claim, 3 Drawing Sheets

TAMPER RESISTANT COVER FOR AEROSOL CAN

BACKGROUND OF THE INVENTION

This invention relates generally to cover means for dispensing containers such as aerosol cans and the like, and more particularly to a tamper resistant and tamper evident detachable cover member for such containers providing visual detection of tampering if prematurely disturbed by a cover removal attempt.

Various locking mechanisms are already known to prevent accidental or inadvertent release of the closure means being employed for dispensing containers of various kinds. In connection with a common type household dispensing container for insecticides, paints and other chemicals, the dispensing end of the container employs a detachable cover or cap which encloses the pour spout in a manner avoiding inadvertent opening. Tamper resistance can be achieved by such means with the prior art closure means operating in various ways. For example, U.S. Pat. No. 4,130,220 discloses a cover for an aerosol type container which is said to be tamper proof until its first removal while thereafter functioning as a child resistant safety cover. The locking mechanism for the double shelled type cover member therein described features a lifting pad on the outer surface of the outer side walls which includes a locking flange partially removed when the cover is released for the first time. A dissimilar locking mechanism is described in U.S. Pat. No. 4,775, 062 for a single shell type cover member. As therein described, inwardly projecting flange or rib elements extend partially around the inner periphery of the cover member for engagement with mating recesses provided on the dispensing container. Removing this cover requires a lateral pushing force causing these flanges or rib elements to become dislodged. A still different locking mechanism to prevent prematurely releasing the contents of the aerosol can is described in U.S. Pat. No. 5,337,912 wherein the cover member again employs flange means extending inwardly from the inner wall surface for engagement with an annular lip or recess provided at the dispensing end of the can.

It remains desirable for such type tamper resistant dispensing containers to still further provide visual detection means if tampered with. Store owners displaying such merchandise as well as customers seeking the merchandise naturally want evidence of any tampering having taken place. By having such cover member released in a manner also easily detected visually if tampered with, both store owners and customers are thereby benefited. It remains still further desirable to provide a release means for these cover members which could also provide the means whereby purchasers of the dispensing container could thereafter furnish evidence of purchasing in connection with rebates and the like.

Accordingly, it is an object of the present invention to provide a dispensing container having a tamper resistant and tamper evident cover means detachably connected thereto.

It is a further object of the present invention to provide a cover member economical to manufacture which is particularly adapted for closure of aerosol cans and employs novel release means.

It is a still further object of the present invention to provide novel release means for a cover member used with dispensing containers which further provides visual detection of tampering if prematurely disturbed by a cover removal attempt.

These and further objects of the present invention will become more apparent upon considering the following detailed description of the present invention.

SUMMARY OF THE INVENTION

It has now been discovered that still more effective means are employed to release the cover member from a dispensing container such as aerosol cans and the like to provide visual detection of tampering as well as resistance to tampering. More particularly, a dispensing container is now provided having dispensing means at one end which enables detachable physical engagement of a replaceable tamper resistant and tamper evident cover member thereat, the cover member having a cup shape formed with top and side wall surfaces terminating in an open bottom, and with said cover member further including an opening formed in the top surface which is closed by solid material means providing a visual indication of tampering if prematurely disturbed by a cover removal attempt. In so doing, the solid material being employed to close the top cover opening can be ruptured or otherwise damaged if physically disturbed by improper tampering efforts although thereafter being properly dislodged when serving to release the cover member. Suitable means for closing the top cover opening in such manner can be provided with a solid disc physically sized smaller than the top cover opening dimensions while being secured thereto with multiple rib elements. A closure element of this type further enables sellers of the dispensing container to provide indicia means on the element as proof of purchase for rebates and the like. The present cover member can be formed by conventional means in a mold employing flexible synthetic polymers such as polypropylene and polyethylene. As such, the molded cover member can employ single shell and double shell configurations to further include conventional internal ribs and flange elements. It is further contemplated that the present molded cover construction can also be employed to enclose the dispensing end of still other type containers than aerosol cans.

To release the present cover member under the proper circumstances entails puncturing the sealed top cover opening with an elongated tool such as a screw driver and the like. By having the top cover opening located sufficiently remote from proximity to the centrally disposed pour spout customarily employed in conventional aerosol containers there can be little danger of accidentally puncturing the container itself during cover removal. In a preferred embodiment for aerosol cans, the present cover member is constructed having both inner and outer side wall elements and with the inner side wall element being centrally disposed so as to surround a further centrally disposed pour spout. Having the top cover opening in said preferred construction displaced so as to lie intermediate said inner and outer side wall elements lessens any danger of puncturing the container itself during cover removal in the indicated manner.

Another preferred construction of the present cover member further facilitating its removal from the dispensing container in the above indicated manner employs a recessed top cover opening. Accordingly, in a preferred molded polymer cover said top cover opening is physically recessed in the top cover surface with ramp means leading to the top surface also being provided for additional guidance of the removing tool when employed.

DETAILED DESCRIPTION OF THE PREFERRED EMBODIMENTS

Figure 1:
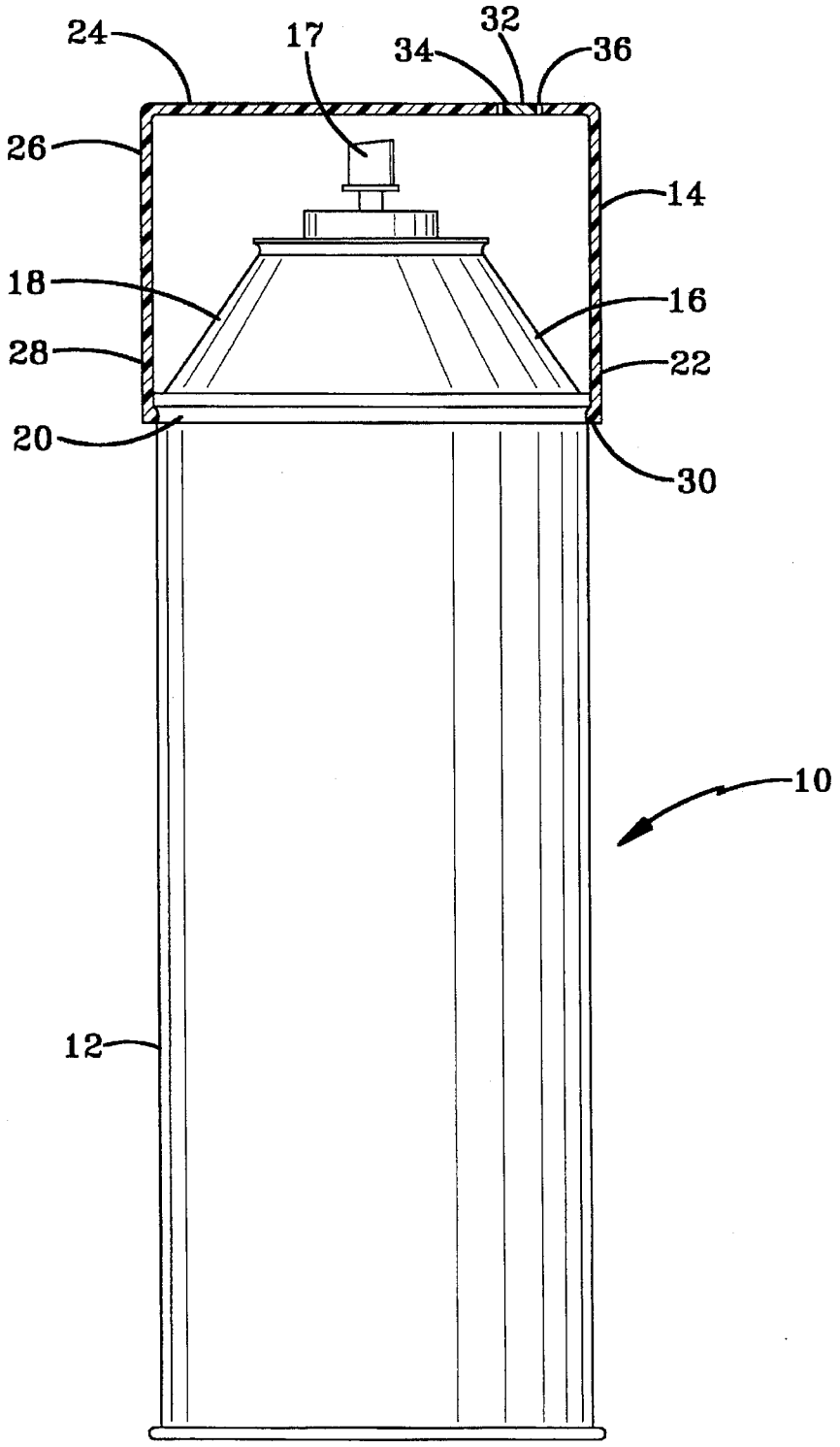
FIG. 1 is a side plan partially in cross section for an aerosol type dispensing container employing a representative cover member in accordance with the present invention.

Referring to the drawings, there is depicted in FIG. 1 a typical aerosol dispensing container 10 having a cylindrical can member 12 to which is attached a single shell type detachable cover member 14 employing the presently improved tamper resistant and tamper evident means. Cylindrical can member 12 terminates at dispensing end 16 in a conventional sloping contour or dome 18 which includes a peripheral recess 20 enabling physical attachment of cover member 14 thereat in the customary manner. As can be seen in the present drawing, dispensing end 16 of the can member 12 further includes a centrally disposed pour spout 17 from which the can contents are released. Cover member 14 has a cup shape 22 formed by top surface 24 and sidewall surface 26 which terminates in an open bottom end 28. An inwardly projecting flange 30 disposed at the bottom end 28 of the said cover member enables locking engagement to the recess 20 provided in can member 14. Cover member 14 can be molded in the customary manner with various flexible synthetic polymers such as polypropylene, polyethylene and the like to further include a closed opening 32 provided in its top surface 24 that provides the means for releasing said cover member from physical attachment to dispensing can 12 in the manner hereinafter more fully described. As can further be seen in the present drawing, however, closed opening 32 in the top cover surface is sufficiently removed from proximity to pour spout 17 so as not to hazard accidental contact therewith when eventually releasing cover member 14 from engagement to can member 12. Closed opening 32 is closed with a solid disc element 34 physically secured in said opening with multiple rib elements 36 for ease of removal by a subsequent purchaser with a puncturing action. In this manner, any tampering of the closed cover opening in order to examine the can contents before purchase can readily be detected visually by store personnel or prospective customers.

Figure 2:
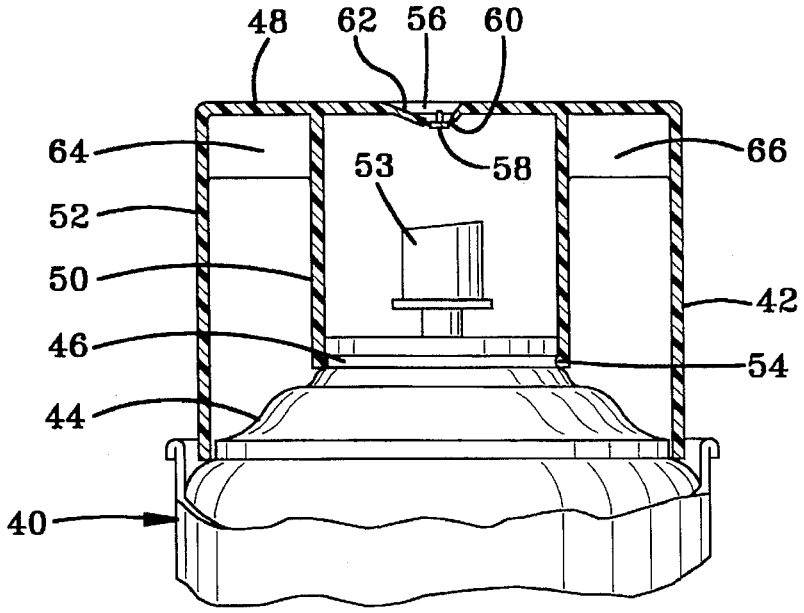
FIG. 2 is a cross sectional view for a different representative cover member of the present invention.

In FIG. 2 there is depicted a cross sectional side view for a similar cylindrical aerosol can member 40 (shown only partially) having attached thereto a double shell type cover member 42 again embodying the tamper resistant and tamper evident means of the present invention. Accordingly, can member 40 includes a dispensing end 44 provided with a peripheral recess 46 for cover attachment thereto. Cover member 42 is constructed with top surface 48 from which extends inner side wall surface 50 and outer side wall surface 52. As can be seen in the present drawing, inner side wall 50 is disposed centrally in said cover member so as to physically surround the pour spout 53 providing in dispensing can 40. An inwardly projecting flange element 54 disposed at the bottom end of inner side wall surface 50 again provides similar means for locking engagement of cover member 42 to can member 40. Cover member 42 further includes a recessed closed opening 56 formed in top surface 48 as the means for releasing said cover member from physical attachment to dispensing can 40. It can further be noted that recessed closed opening 56 is disposed intermediate the side wall surfaces in cover member 42 so as to again avoid accidental contact with pour spout 53 when removing said cover in the previously described manner. Top recessed cover opening 56 is again closed with a solid disc element 58 secured to the opening sides with multiple rib elements 60 for removal after purchase. For a cover member having such recessed opening it becomes further possible to contour the opening sides 62 so as to have a ramp contour (as shown) leading to the top surface 48 for guidance of the removing tool when employed. As will be further described hereinafter in connection with such cover removal a pair of internal reinforcing ribs 64 and 66 provided in the cover member can be of assistance in doing so.

Figure 3:
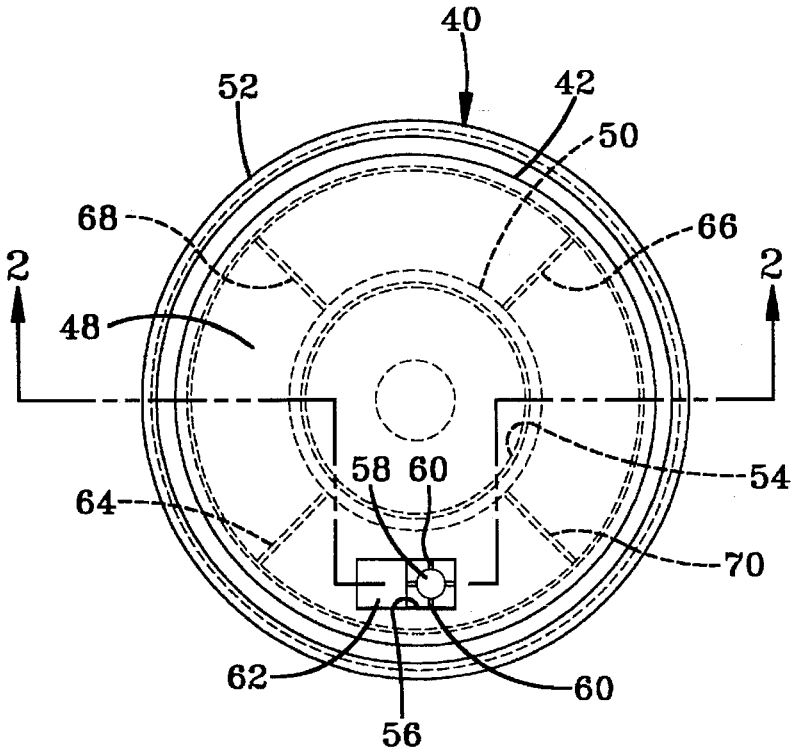
FIG. 3 is a top plan view partially in cross section for the FIG. 2 cover member.

FIG. 3 is a top plan view partially in cross section depicting further details of the FIG. 2 dispensing container embodiment. As herein shown, cover member 42 is detachably secured to aerosol can member 40 in the previously described manner and with the closed top cover opening 56 still being in place. Accordingly, cylindrical cover member 42 includes inner and outer wall surfaces 50 and 52, respectively, being joined together with four reinforcing rib elements 64, 66, 68 and 70 while top surface 48 includes said recessed opening 56. Inwardly projecting flange element 54 which detachably secures said cover member to the aerosol container appears only in phantom in the present drawing. The closed opening 56 in said cover member can be seen as having a circular configuration with solid disc element 58 being secured to said opening by multiple rib elements 60. As can be seen, said recessed top cover opening further includes tool guide means 62 to assist with inserting an elongated tool when releasing the cover member after purchase.

Figure 4:
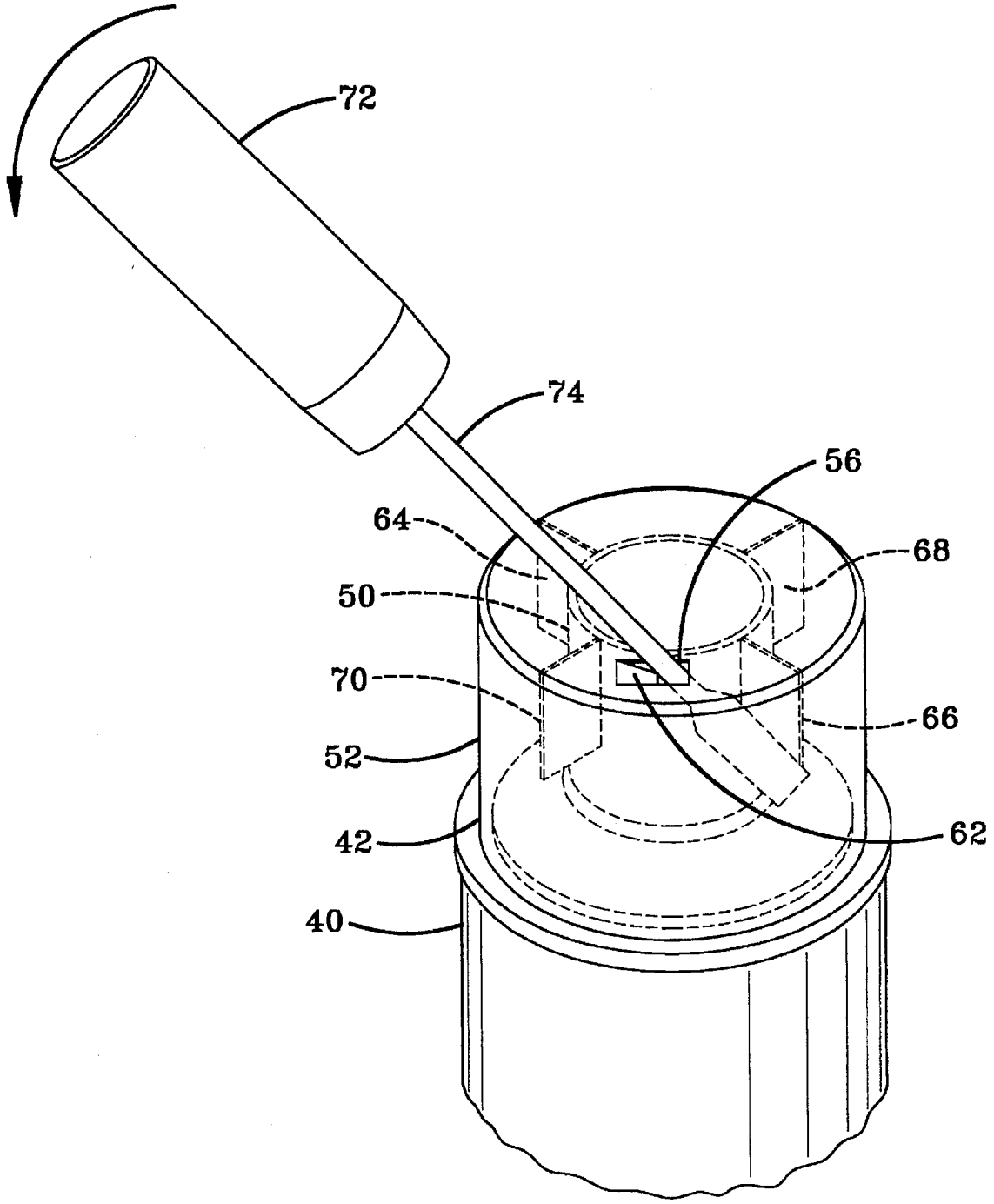
FIG. 4 is a perspective view partially in cross section depicting representative release means for the FIG. 2 cover member.

FIG. 4 is a perspective view partially in cross section depicting representative means whereby the tamper resistant and tamper evident cover means described above in FIGS. 2–3 can be released from attachment to the aerosol type dispensing container after purchase by a customer. Accordingly, the same numerals are again retained in the present drawing to identify common structural components in said dispensing container embodiment. As can be seen, aerosol can member 40 having cover member 42 attached thereto is depicted in the present drawing with a screw driver or similar tool implement 72 having been inserted into the closed opening 56 provided in said cover member. In doing so, the inserted tool is guided into said recessed top cover opening along tool guide means 62 with sufficient mechanical force to dislodge the disc element (not shown) being employed to enable visual detection of any prior tampering efforts. When inserted into said opening in such manner, the inner side wall surface 50 provided in said cover member to protect the pour spout 53 (not shown) at the dispensing end of the can member understandably serves to prevent contact between the screw driver blade 74 and said pour spout. The inserted end of screw driver blade 74 is further prevented from puncturing the domed end of the aerosol can member by a blocking action provided with reinforcing rib elements 66 of the cover member. Release of said cover member with the tool having been inserted in this manner simply entails a further prying action by the customer.

It will be apparent from the foregoing description that broadly useful and novel means have been provided to avert tampering with various type dispensing containers prior to purchase. It is contemplated that such tamper resistant and tamper evident means can be employed for a broad range of dispensing containers other than above specifically illustrated, however, to include containers other than aerosol cans. Likewise, it is contemplated that enhancement of resistance to tampering with the herein disclosed cover member means can possibly still further be improved utilizing additional means for detachably securing the cover member to the dispensing container. Substituting still other materials than herein illustrated for construction of the dispensing container and/or the cover member are similarly further contemplated. Consequently it is intended to limit the present invention only by the scope of the appended claims.

What I claim as new and desire to secure by Letters Patent of the United States is:

1. An aerosol container having a centrally disposed dispensing valve means at one end enabling detachable physical engagement thereat of a replaceable tamper resistant and tamper evident cover member, the cover member having a cup shape formed with a top wall, an outer side wall and an inner side wall disposed centrally to surround the dispensing valve means, both side walls terminating in an open bottom end with the inner side wall having an inwardly projecting flange disposed at the open bottom end for locking engagement of the cover member to the aerosol container, multiple internal reinforcing rib elements physically connecting the outer surface of the inner wall to the inner surface of the outer wall, the cover member having a recessed area in the surface of the top wall disposed intermediate the inner and outer side walls, said recessed area being covered by a frangible member connected to the top wall, said frangible member being puncturable by an inserted tool to provide leverage to remove the cover member, and downward sloping guide means for tool insertion being disposed in the recessed area of the top wall.

* * * * *